United States Patent [19]

Pelczarski

[11] Patent Number: 4,483,580

[45] Date of Patent: Nov. 20, 1984

[54] ELECTRICAL CONNECTORS WITH PROTECTIVE HOOD

[75] Inventor: Walter J. Pelczarski, Downers Grove, Ill.

[73] Assignee: Allied Corporation, Southfield, Mich.

[21] Appl. No.: 419,387

[22] Filed: Sep. 17, 1982

[51] Int. Cl.[3] ..... H01R 13/56

[52] U.S. Cl. ..... 339/103 M

[58] Field of Search ..... 339/103 R, 103 M, 105, 339/107

[56] References Cited

U.S. PATENT DOCUMENTS

| | | | |
|---|---|---|---|
| 4,130,330 | 12/1978 | Chandler | 339/103 M X |
| 4,203,643 | 5/1980 | Krolak et al. | 339/107 |
| 4,211,463 | 7/1980 | Chandler | 339/103 M |
| 4,432,592 | 2/1984 | Boutros et al. | 339/103 M |

*Primary Examiner*—Eugene F. Desmond

*Attorney, Agent, or Firm*—C. D. Lacina

[57] ABSTRACT

A protective hood for a rectangular electrical connector is described in which the hood is provided with flexible sidewalls. A locking member and cam member is provided adjacent the free edge of each sidewall near the opening to the recess in the hood into which the connector is positioned. During assembly of the hood to the connector, the cam members flex the sidewalls away from the connector to prevent the locking members from locking onto the connector. When fully assembled, the cam members release the sidewalls to allow the locking members to lock onto the connector with an audible "snap."

The hood may be unlocked and removed from the connector by manually flexing the hood sidewalls away from the connector. In one form of the invention this may be done by manually applying force to one end of the bottom of the hood.

11 Claims, 6 Drawing Figures

ELECTRICAL CONNECTORS WITH PROTECTIVE HOOD

DESCRIPTION

BACKGROUND OF THE INVENTION

1. Field of the Invention

This invention relates to hooded electrical connectors and protective hoods for such connectors, and more particularly to an all plastic hood for "all plastic" connectors which become securely locked to such connectors with an audible signal or "click".

2. Description of the Prior Art

It is commonplace in the electrical connector art, and more particularly in respect of telecommunication type electrical connectors, to provide some form of protective cover or hood for the conductor termination ends of such connectors.

Typically, a telecommunication connector is mounted on a rack and panel support array or chassis through an aperture so that the mating end portion of the connector is accessible for coupling or mating with a complementary connector from the front of the panel or chassis. On the other hand, the conductor termination end portion of such a connector is made accessible from the rear of the panel or chassis to allow electrical conductors to be connected to various contacts of the connector or to allow the testing of various circuits with which the connectors are associated by selectively contacting one or more of the contacts in the connector with a test probe.

Thus, after the installation of a number of such connectors, on a panel or chassis, the contacts of the connector, as well as bared conductor portions of insulated wires to which they are terminated, are vulnerable to potentially hazardous unwanted shortcircuiting so grounding by stray pieces of solder, metal or other conductive materials inadvertently falling upon and between the contacts or conductors. Additionally, during the maintenance of such equipment, the conductive portions of tools or other objects may inadvertently produce such shortcircuiting or grounding.

Accordingly, protective hoods, preferably of plastic or other nonconductive material, have been used to snap-on or slide on and over the termination end portion of such connectors after the contacts thereof have been terminated with conductors to prevent the aforesaid unwanted, inadvertent bridging, shorting or grounding. Typical examples of such prior art hoods and associated connectors, and particularly where the connector body, or hood, or both are fabricated of plastic, or other nonconductive material, are illustrated in U.S. Pat. Nos. 3,657,682; 3,803,530; 3,936,129; 4,035,051; 4,070,548; 4,089,579; 4,090,770 and 4,203,643.

While such prior art hoods, when employed with their associated connectors, have met with some success in the marketplace, they suffer from a number of disadvantages. Most significantly, the manner in which many of the prior art protective hoods are assembled and disassembled from their respective connector bodies requires the use of screws or other fastening devices in order to ensure that the hoods are not easily inadvertently dislodged from their respective connector. On the other hand, a number of hood and connector configurations have been constructed where the hood is "self-latching" or "self-locking" such that when the hood is assembled to the connector, complementary bosses and detents on or in the hood and a separate part mounted on an end flange of the connector engage to secure the hood to the connector. Typically, such bosses extend outwardly from the side surfaces of a cable clamp member affixed to the connector to engage complementary apertures or recesses in the hood. Apart from the relatively high cost of such prior art arrangements, considerable manual force, manual dexterity or the use of special tools is required in the removal of such hoods. Additionally, in completing the assembly of such prior art hoods upon respective connectors, there is insignificant, if any, audible signal that a lock between the hood and the connector has, in fact, been secured. Should a lock not be secured, the hood may easily become dislodged from the connector thereby exposing the contacts of the connector to the aforementioned hazards.

SUMMARY OF THE INVENTION

In accordance with the invention, a hood for the termination end portion of an electrical connector is provided. The hood is formed of relatively thin flexible material having elastic properties and comprises two sidewalls, an end wall and a bottom wall to define an open ended cavity with a partially closed top dimensioned to snugly embrace the termination end portion of the connector by longitudinally sliding the hood thereover. Locking means carried in part by at least one sidewall are provided to automatically lock the hood to the connector in the fully assembled position of the hood on the connector. Ramp means interacting between the sidewall and the connector displaces the sidewall away from the connector during the principal portion of the hood assembly procedure to disenable the locking means until the hood reaches its finally assembled position whereupon the camming means abruptly releases the hood with an audible snap to enable said locking means.

The hood is removable from the connector by simply manually flexing one or both sidewalls laterally away from the connector body to disenable the locking means whereupon the hood may be slidingly removed from the connector. For one form of the invention, the aforesaid manual flexing is accomplished by applying a transverse pressure between the hood and connector to cause a transverse cam surface on one or the other of the sidewalls and a rail extending longitudinally along the side surface of the connector to engage one another whereupon the sidewall flexes laterally away from the connector so as to disenable the locking means whereupon the hood may be slidingly removed from the connector by applying a longitudinal relative pressure between the hood and connector.

More specifically, the hood comprises an elongate body formed of relatively thin flexible material having elastic or spring properties, such as plastic or the like. The hood has a cavity therein with one open end and partially open top defined by two sidewall portions and an end wall portion extending upwardly from the two lateral extremities and one end extremity, respectively, of a bottom wall portion. The cavity is closed at one of its longitudinal extremities by the aforesaid end wall portion and dimensioned at its open end to both snugly receive the conductor termination end portion of the connector and freely receive the wire conductors of a multiconductor cable which may be terminated thereto. Extending along the longitudinally running top edge of each sidwall portion is a lip with each lip extending laterally inward from its sidewall toward the other to partially close the top of the cavity. A hood supporting rail receiving recess is provided in each sidewall portion immediately adjacent to the bottommost surface of each lip and running longitudinally of its respective sidewall portion and generally parallel to its respective lip. Each recess is open at the extremity thereof which is adjacent to the open end of the cavity and is dimensioned to freely receive the hood support rails extending from a typical connector. The longitudinal extremity of at least one of the lips adjacent to the open end of the cavity is in the form of a ramped latch hook configured such that after the hook is allowed to slide over the connector body, by the lateral flexing of the hood sidewall material during assembly of the hood upon the connector, the elastic properties of the hood sidewalls causes the hook to latch against the laterally extending end surface of the connector body so as to lock the hood to the connector with an audible snap to signal the termination of the hood assembly procedural sequence.

DESCRIPTION OF A PREFERRED EMBODIMENT

Figure 1:
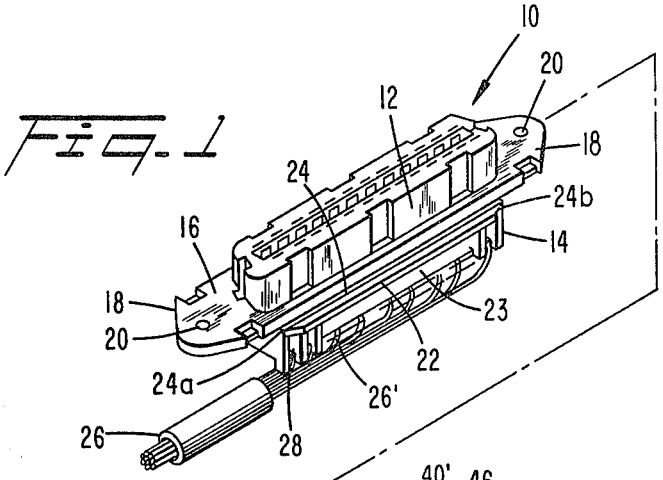
FIG. 1 is a perspective view of an electrical connector suitable for receiving a protective hood constructed in accordance with the present invention and of a form shown in FIG. 2.

Turning now to FIG. 1, a one-piece all plastic electrical connector 10 is shown, having a mating end portion 12 and a conductor termination end portion 14 formed integral with a base or support portion 16. At each longitudinal extremity of the base portion 16, a mounting flange portion 18 is provided with holes 20 for mounting the connector 12 to a printed circuit board, metal chassis, rack panel or the like through the use of suitable fasteners.

Typically, the conductor termination end portion of a connector such as 10 is provided with hood support means such as longitudinally running rails 22. Each of the rails extends laterally outwardly from a respective major side surface 23 of the connector conductor termination portion 14 from a position displaced from the lowermost surface of the base 16 to form a longitudinally running recess 24 open at each of its ends 24*a* and 24*b*. A multiconductor cable is depicted at 26 having various of its conductors 26' connected to the termination ends of electrical contacts held within connector 10.

The mating portion 12 of connector 10 will, in accordance with custom, be considered the front portion of the connector while the conductor termination portion 14 will be considered the rear portion of the connector.

Figure 3:
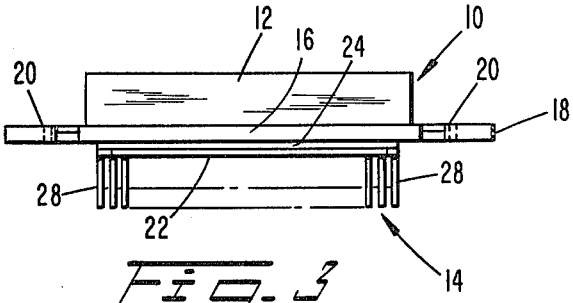
FIG. 3 is a side view of this electrical connector shown in FIG. 1.
Figure 5:
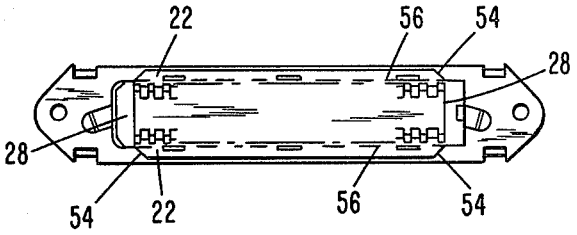
FIG. 5 is a bottom view of the connector shown in FIG. 1.

The conductor termination or rear portion 14 of the connector 10 is of generally rectangular configuration and includes two substantially flat end surfaces 28, each surface extending laterally between the major side surfaces and transversely from the lowermost surface of base 16, best seen by reference to FIGS. 1, 3, and 5.

Figure 2:
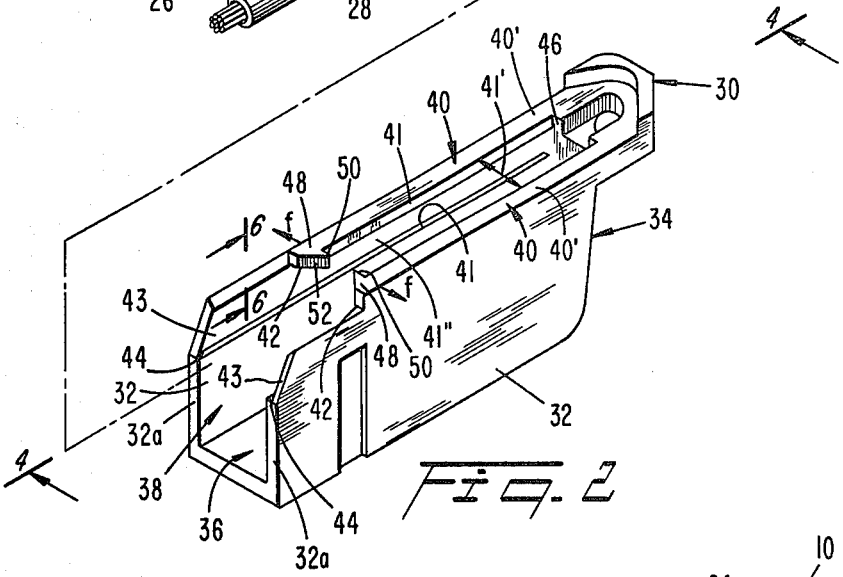
FIG. 2 is a perspective view of a protective hood constructed in accordance with the present invention for use with an electrical connector of a type shown in FIG. 1.

Turning now to FIG. 2, a protective hood 30 constructed in accordance with the present invention is shown, and as will become more clearly apparent hereinafter, is adapted to engage the hood support rails 22 of connector 10 and slide across the longitudinally extending surfaces of the connector conductor termination portion 14. The hood then acts as a protective cover for the conductor termination portion 14 of the connector to protect exposed surfaces of the conductors 26' and the respective contacts to which they are connected from inadvertent shortcircuiting or grounding after the protective hood has been assembled.

In accordance with the present invention, at the termination of the hood assembly process, the hood positively engages the conductor termination end portion of the connector with an audible and distinct signal or "snap".

More specifically, and still referring to FIG. 2, hood 30 is made of a flexible plastic material such as ABS Cycolac KJB and comprises two longitudinal sidewall portions or members 32 (see also FIG. 4) and an end wall portion or member 34 extending generally perpendicularly from the two lateral extremities and from one longitudinal end extremity, respectively, of a bottom wall portion or member 36. Cavity 38 which is thus formed is closed at the one longitudinal extremity by the end wall portion 34. The hood is dimensioned such that the lateral distance between the inner surfaces of the two sidewall portions 32 allow the conductor termination end portion 14 to be freely received within the cavity 38.

As shown in FIG. 2, the top or uppermost extremity of each sidewall 32 is provided with a longitudinally extending lip member 40. The lip members 40 have an outermost or top surface 40', a lowermost or bottom surface 42, and extend laterally inwardly toward one another to partially close the cavity 38 at its top. Preferably, the lateral distance 41' between the opposing surfaces 41 of the two lip members 40 which define the longitudinally extending rectangularly shaped opening 41'' is such that the lips snugly embrace the side surfaces of the connector. A recess 43 indicated between reference numerals 42 and 44 is provided in each sidewall at a position immediately adjacent to the lowermost surface 42 of each lip member and runs longitudinally of the hood 30 and generally parallel to the bottom wall portion 36. Each of the recesses are dimensioned to receive the hood support rails of the connector 10 upon assembly of the hood 30 to the connector 10.

Figure 4:
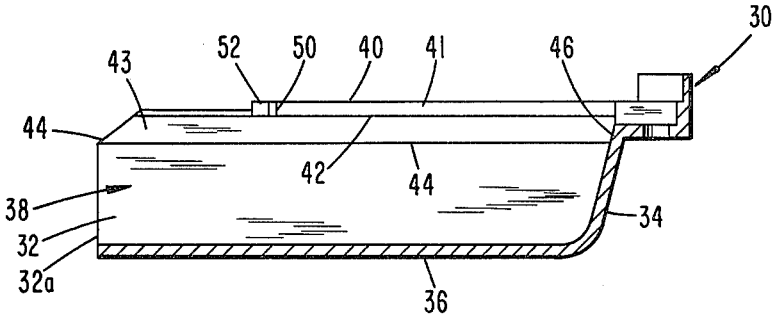
FIG. 4 is a planar cross-sectional view of the hood shown in FIG. 2 taken along a plane defined by a line 4—4 and looking in the direction of the arrows.

As shown in FIGS. 2 and 4, the left-hand extremities of each recess 43 immediately adjacent to the open end of cavity 38 is, in turn, open to receive the connector hood support rails. The other ends of these recesses are closed as shown at 46.

In accordance with the present invention and as best seen in FIG. 2, the left-hand extremities of the lip members 40 are provided with a ramp 52 which, in the emodiment shown, form part of a ramped latch hook 48. Each hook 48 has a planar locking surface 50 extending substantially perpendicularly from surface 41 thereof and intersecting with the peak of its ramp. Additionally, in a preferred embodiment of the present invention, the longitudinal extremities of the hood support rails 22 of connector 10 are chamfered as shown at 54 (see FIG. 5) to ease hood assembly on the connector. In further accordance with the present invention, the distance between the latching or locking surfaces 50 and the closed extremities 46 of the recesses 43 are dimensioned such that when the hood 30 is fully assembled on connector 10, the closed extremities 46 engage one end surface 28 and the locking surfaces 50 engage the other end surface 28 of the conductor termination portion 14 of the connector.

As hereinbefore noted, in accordance with the present invention, the lateral distance between the two surfaces 41 of the two lip members 40 are such that these surfaces snugly engage the major side surfaces 56 (see FIG. 5) of the connector conductor termination end portion 14 when the hood is fully assembled thereon.

The hood 30 is positioned so that the sidewalls 32 have their end faces 32*a* adjacent to the end 24*b* and assembled on the connector 10 by engaging the recesses 43 of the hood with the hood support rails 22 and by longitudinally sliding the hood along the rails in the direction towards the end 24*a* (FIG. 1).

Upon the initial engagement of the recesses 43 and rails 22, each of the ramp surfaces 52 of the hooks 48 engage one of the major side surfaces 23 and, due to the elastic properties of the sidewall material, displace each of the sidewall portions 32 in a direction laterally away from the major side surfaces of the connecter by a force "f" and as shown by the arrows with the letter "f" associated therewith. Upon the hood reaching its fully assembled position on the connector, the hooks 48 are forced inwardly and over the end surfaces 28 of the connector by the elastic forces produced by the hood wall material. The relatively planar locking surfaces 50 when seated behind the end surfaces lock or latch the hood to the connector so as to inhibit relative longitudinal movement therebetween.

Thus, in accordance with the invention, the ramp means act to disenable the locking or latching means 50 until the hood is fully assembled on the connector. Although the ramp member and locking means are shown as being formed as a hook 48, it will be appreciated that these two elements may be formed at displaced positions on the hood. Moreover, it is contemplated that the locking means may act upon other surfaces of the connector body which are complementary to the locking surfaces defined by the hood walls.

To remove the hood from the connector, one or both of the hood sidewall member(s) 32 may be manually flexed away from the connector body by means of the fingers on a human hand applying a sufficient lateral force "f" on the sidewall portions so as to disengage planar locking surface(s) 50 of the hook(s) 48 from their seating behind the end surface 28 at the end 24*a* of the connector. This will thereby disenable the locking means whereupon the hood may be slid along the rails 22 and removed from the connector 10.

Figure 6:
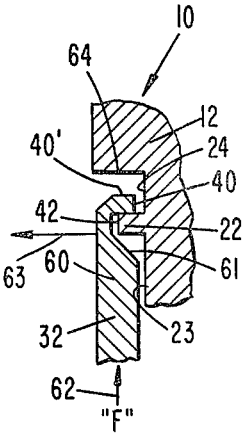
FIG. 6 is a planar cross-sectional view of a modified portion of one hood sidewall taken along a plane defined by line 6—6 of FIG. 2 and illustrating the cooperation between a ramped surface of the rail engaging recess therein and a hood support rail of a connector.

Turning now to FIG. 6, in a preferred form of the present invention, the manual flexing of one or both of the sidewall members 32, incident to hood removal as aforesaid, may be accomplished by simply pushing bottom wall member 36 adjacent the open end of the hood toward the connector 10. This is made possible by providing the lowermost surface of each rail receiving recess 42 with a ramped section 60 having a cam surface 61. The ramped section should be placed in close juxtaposition to the hooks 48. Thus, when a force "F" is placed on the bottom wall portion 36 of the hood in the direction of arrow 62 towards the connector 10, the cam surface 61 of the ramped section 60 will engage the lower edge of the rail 22. This will then cam the sidewall 32 in the direction of arrow 63 or laterally away from the side surface of connector termination portion 14 as the hood moves toward the connector in the direction of arrow 62. The dimensions or distance between the upper outer surface 40' of hood lip member 40 and the adjacent surface 64 of connector termination portion 14 as well as the dimension of the active portion of cam surface of ramped section 60 is such that the extent of hood wall flexing will be such to disengage the hooks 48 from the connector body so that the hood may be removed from the connector as described hereinbefore.

Alternatively, the ramped section 60 may be eliminated and the outer lower edge of rail 22 chamfered to provide a ramp surface which will cooperate with the lower edge of recess 43 to effectuate the aforesaid flexing of the sidewall when the bottom of the hood is pushed.

It will be understood that the invention described hereinabove may be embodied in other specific forms without departing from the spirit or central characteristics thereof. The present examples and embodiments therefore are to be considered in all respects as illustrational and not restrictive and the invention is not to be limited to the details given herein, but only in accordance with the appended claims when read in the light of the foregoing specification.

What is claimed is:

1. A protective hood for the termination end portion of an electrical connector, said hood comprising:

a first and second sidewall member formed of stiff material with elastic properties joined to an end wall and a bottom wall member to form an open ended cavity with a substantially open top, the cavity being dimensioned to snugly receive and contain the termination end portion of the connector when said end portion is moved in a longitudinal direction relative to the hood into the open end of said cavity, locking means carried at least in part by at least one sidewall member for automatically locking the hood to the connector in response to the elastic properties of said sidewall member when the hood reaches its fully assembled position on the connector, unlocking means carried at least in part by said one sidewall and operating in response to a transverse force on the hood tending to move the hood and the connector together for unlocking the hood from its fully assembled position on the connector, and camming means carried at least in part by said one sidewall member adjacent the open end of said cavity for interacting with the termination end portion of the connector so as to displace said sidewall member in a direction laterally away from the connector during the principal portion of the longitudinal movement of the hood relative to the connector during its assembly thereon to disenable said locking means until the hood reaches its fully assembled position, whereupon the camming means allows the hood wall member to abruptly return to its predisplacement condition with an audible "snap" and lock the hood to the connector.

2. A protective hood according to claim 1 wherein said one sidewall is provided with a lip extending longitudinally along and laterally inward therefrom toward the said other sidewall and said camming means includes a ramp positioned near the longitudinal and lateral extremities of said lip adjacent the open end of said cavity for displacing said lip and its sidewall in a direction laterally away from said connector upon its entry into said hood cavity.

3. A protective hood according to claim 2 wherein said locking means includes a laterally extending locking surface which is substantially perpendicular to the longitudinal edge of said lip and said ramp includes a ramp surface which terminates at its intersection with the locking surface.

4. A protective hood according to claim 3 wherein said locking means comprises said relatively planar surface of said ramp termination and wherein said ramp is positioned relative to the open end of said cavity so as to engage one longitudinal extremity of the termination end portion of a connector when said hood is fully assembled on the connector.

5. A protective hood according to claim 1 wherein said locking means carried by said sidewall member comprises means defining a laterally extending surface which is complementary to and positioned relative to the open end of said cavity so as to be engageable with a surface defined by a portion of said connector when said hood is fully assembled thereon to inhibit longitudinal motion of said hood relative to the connector according to claim 3.

6. A protective hood according to claim 1 wherein said unlocking means comprises a transversely extending cam surface for engaging the connector to displace the sidewall member in a direction laterally away from the connector after assembly of the hood to the connector.

7. In combination, an electrical connector having a substantially rectangular termination end portion and a protective hood covering said end portion, said connector having a longitudinally extending hood support rail on at least one major side surface of said termination end portion, said hood being formed of relatively thin flexible material having elastic properties and comprising at least two sidewalls extending from a bottom wall with means formed on the inner side of at least one sidewall adjacent the uppermost extremity thereof for engaging said hood support rail so as to allow said hood to be slidably attached to and removed from said connector, first and second ramp means associated with at least one sidewall adjacent said rail engaging means for moving said sidewall in a direction laterally away from said side surface against elastic forces produced by said sidewall material, said first ramp means for engaging the side surface of said connector termination end portion during londitudinal sliding assembly of said hood on said connector, and locking means including a locking surface extending laterally from said one sidewall in relatively close juxtaposition to said first ramp means for engaging said termination end portion only when said hood reaches its fully assembled position on said connector and said ramp disengages said major side surface, said second ramp means for enabling laterally disengaging said locking surface from a condition of full assembly of said hood on said connector.

8. The combination according to claim 7 wherein said termination end portion is chamfered at each longitudinal extremity thereof to form ramp surfaces for sliding interengagement with said hood ramp means during assembly of said hood upon said connector.

9. The combination according to claim 7 wherein said second ramp means carried by said hood and said connector is responsive to the application of transverse pressure between said connector and said hood for disenabling said locking means.

10. The combination according to claim 7 wherein said hood support rail has upper and lower longitudinally extending surfaces and wherein said hood support rail engaging means comprises a longitudinally extending recess having a upper and a lower surface for engaging, respectively, the upper and the lower surface of the hood support rail and wherein said second ramp means comprises a cam surface operating between at least a portion of said lower surface of said recess and at least a portion of said lower surface of said rail such that manual pressure upon the bottom wall of said hood and tending to move said hood towards said connector will cause said sidewall to flex laterally and disenable said locking means whereby said hood after being fully assembled upon said connector may be removed therefrom.

11. In an electrical connector having a protective hood releasably mounted thereon the combination of: locking means carried by said hood and said connector for locking said hood to said connector when said hood is fully assembled thereon by relative longitudinal movement therebetween, and means defining a ramp carried by said hood and operative against said connector responsive to the application of transverse pressure therebetween from an external force on said hood perpendicular to the plane of movement of said hood for laterally disenabling said locking means such that said hood may be slidably removed from said connector.

* * * * *